US005167528A

United States Patent [19]

Nishiyama et al.

[11] Patent Number: 5,167,528

[45] Date of Patent: Dec. 1, 1992

[54] METHOD OF MANUFACTURING AN ELECTRICAL CONNECTOR

[75] Inventors: Youichi Nishiyama; Hisahiro Ono, both of Tsu, Japan

[73] Assignee: Matsushita Electric Works, Ltd., Osaka, Japan

[21] Appl. No.: 685,656

[22] Filed: Apr. 16, 1991

[30] Foreign Application Priority Data

Apr. 20, 1990 [JP] Japan ..... 2-42849[U]
Feb. 25, 1991 [JP] Japan ..... 3-30386

[51] Int. Cl.[5] ..... H01R 3/00

[52] U.S. Cl. ..... 439/489; 439/284; 29/883; 29/884

[58] Field of Search ..... 439/284, 287, 290, 291, 439/295, 488, 489, 736; 264/272.11, 272.14, 318; 29/883, 884, 747

[56] References Cited

U.S. PATENT DOCUMENTS 4,337,574 7/1982 Hughes et al. ..... 29/884 X
4,863,402 9/1989 Black et al. ..... 29/883 X
5,074,039 12/1991 Hillbish et al. ..... 29/884 X

FOREIGN PATENT DOCUMENTS 0195672 8/1990 Japan ..... 439/489

OTHER PUBLICATIONS

IBM Technical Bulletin, vol. 1, No. 4, Dec. 1958.

*Primary Examiner*—Paula A. Bradley
*Assistant Examiner*—Khiem Nguyen
*Attorney, Agent, or Firm*—Leydig, Voit & Mayer

[57] ABSTRACT

A connector includes a pair of housings mutually engageable integrally, and a plurality of contactors secured at their base portions to each of the housings so that the contactors of the both housings are contactable with each other respectively at their free ends when the housings are engaged integral to each other, mutually with a clicking resiliency provided by means of a sloped step made in each contactor between the base and free end portions, whereby the contactor capable of providing a reliable clicking action denoting completion of the connection is rendered manufacturable without requiring highly precise administration.

2 Claims, 9 Drawing Sheets

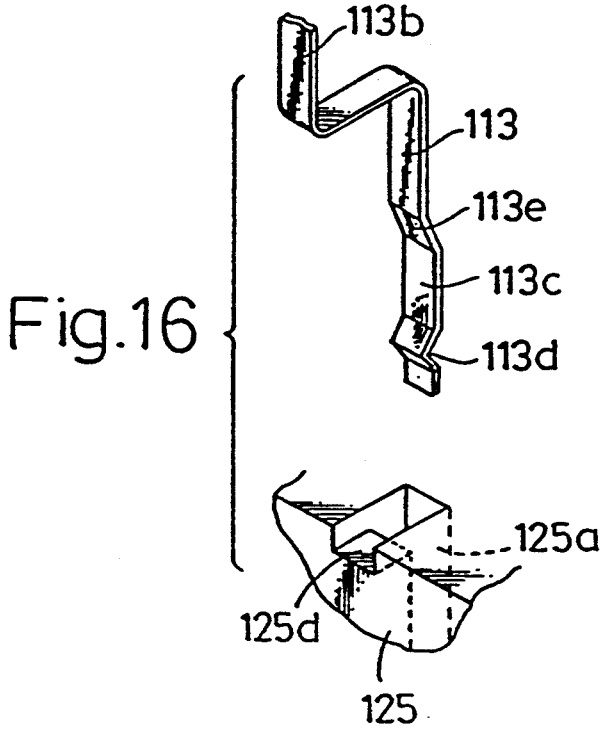
Fig.16
Fig.17
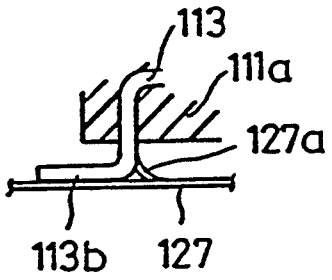
Fig.18
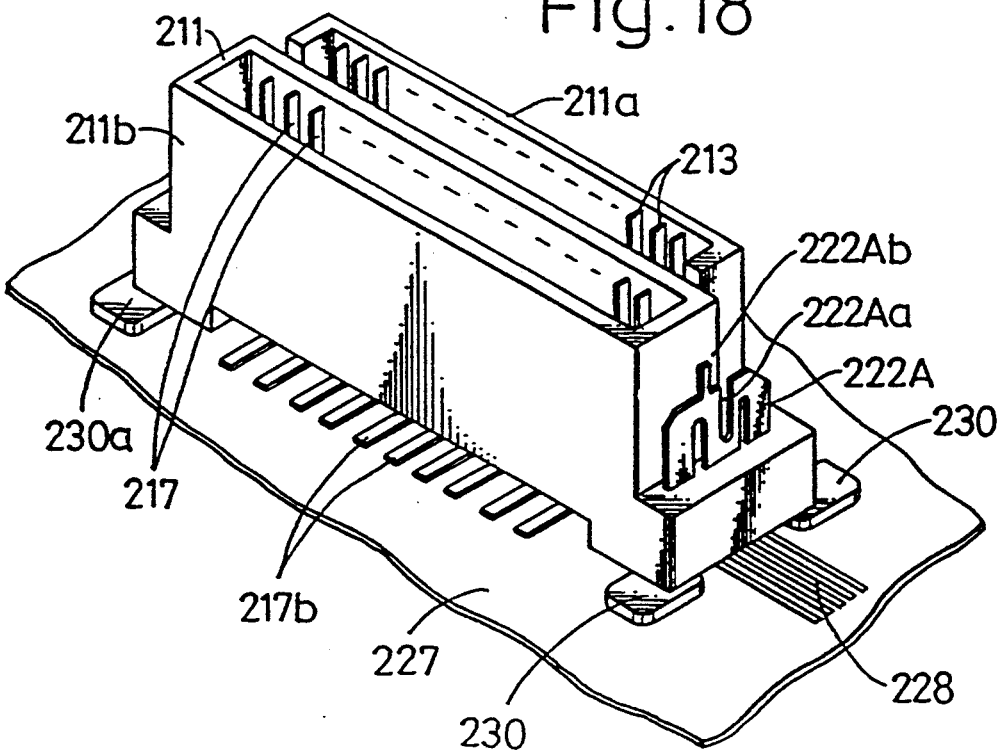

METHOD OF MANUFACTURING AN ELECTRICAL CONNECTOR

BACKGROUND OF THE INVENTION

This invention relates to connectors and methods for manufacturing the same.

The connectors of the kind referred to find their utility specifically when used at a multiple-wire connecting section in various types of wiring systems.

DESCRIPTION OF RELATED ART

For the connector of the kind referred to, an example has been disclosed in Japanese Laid-Open Utility Model Publication of A. Shimada, in which one of a pair of housings made of a synthetic resin is formed to have a projecting wall while the other housing is provided with a recess for accommodating the projecting wall so that the both housings will be engageable with each other, contactors of bar-shaped conducting metal material are provided on both sides of the projecting wall and opposing side walls of the recess, and the corresponding ones of the contactors are mutually contactable upon the engagement of the both housings.

In this instance of the known connector, the contactors are provided in the identical configuration throughout the ones on both sides of the projecting wall of the one housing and the ones on the opposing side walls of the recess of the other housing, so that these conductors are embedded at their base end portion in the housings while they are respectively provided with a tapered face slanted toward free end portion and swelled at the free end to be a contacting part by means of an expanding work or the like, corresponding ones of the contactors come into contact with each other at two points when the pair of the housing are engaged to each other so as to attain a highly reliable connection between the contactors of the both housings.

In the engagement of the both connector housings, however, the swelled contacting parts are caused to simply slide along the tapered face, so that it has been uneasy to clearly determine with finger tip of the like tactile sense and, if the contactors are inserted beyond a proper contacting degree between the contactors, there arises a problem that the housings are thereby caused to be damaged. While it may be possible, on the other hand, to arrange the contactors so that corresponding ones of the contactors are properly brought into contact at two points with each other when the pair of the housings are intimately engaged to each other, the tapered faces of the respective contactors are required to be so controlled as to be constant in the tapered angle, whereby it is made necessary to execute the expansion work or the like with a highly controlled amount of the working, and there arises a problem that the manufacture becomes extremely complicated. This tendency becomes more remarkable as the contactors are made smaller and, when the contactors are formed through the expansion work, it becomes more complicated to deal with expansion fins as the contactors are made smaller, so as to render the manufacture to be difficult in general, to be detrimental in elevated costs.

SUMMARY OF THE INVENTION

A primary object of the present invention is, therefore, to provide a connector which is capable of allowing the connecting and disconnecting operation to be smoothly performed, providing a reliable clicking action upon completion of the connection to assure a clear tactility of the connection completion, and rendering the manufacture to be extremely easy and inexpensive while still allowing the size of the connector to be sufficiently minimized.

According to the present invention, this object can be established by a connector in which a pair of housings are provided for being mutually engageable, and contactors made to have an elasticity are secured at their base portions to each of the housings to be mutually resiliently brought into contact at contacting parts formed at free ends, wherein the contactors are provided respectively with a sloped step between the secured base portion and the free end for providing a clicking action.

Other objects and advantages of the present invention shall be made clear in following description of the invention shall be made clear in following description of the invention detailed with reference to accompanying drawings.

BRIEF EXPLANATION OF DRAWINGS

FIGS. 16 and 17 are explanatory views for a couple of parts of manufacturing steps of the connector shown in FIG. 8;

FIG. 18 shows in a perspective view one of the housings employed in a further embodiment of the connector according to the present invention;

While the present invention shall now be described with reference to the preferred embodiments shown in the accompanying drawings, it should be appreciated that its intention is not to limit the present invention only to such embodiments shown but rather to include all alterations, modifications and equivalent arrangements possible within the scope of appended claims.

DETAILED DESCRIPTION OF THE PREFERRED EMBODIMENTS

Figure 1:
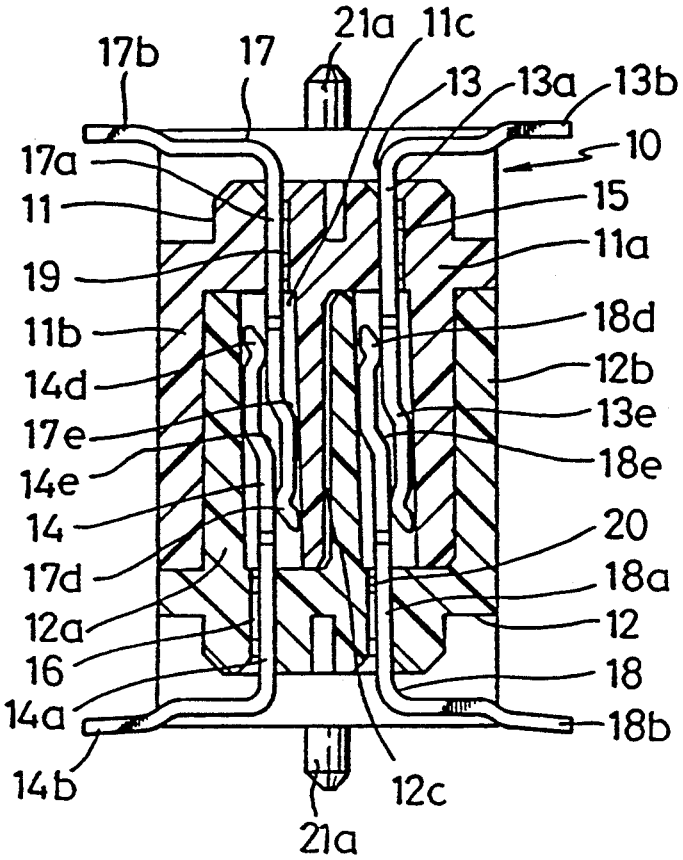
FIG. 1 shows in a cross section of an embodiment of the connector according to the present invention, shown in mutual engaging state of a pair of housings.
Figure 3:
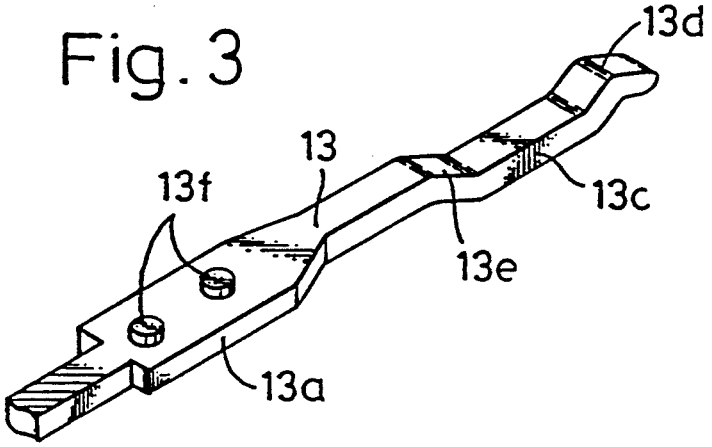
FIG. 3 shows in a perspective view one of contactors employed in the connector of FIG. 1.
Figure 2:
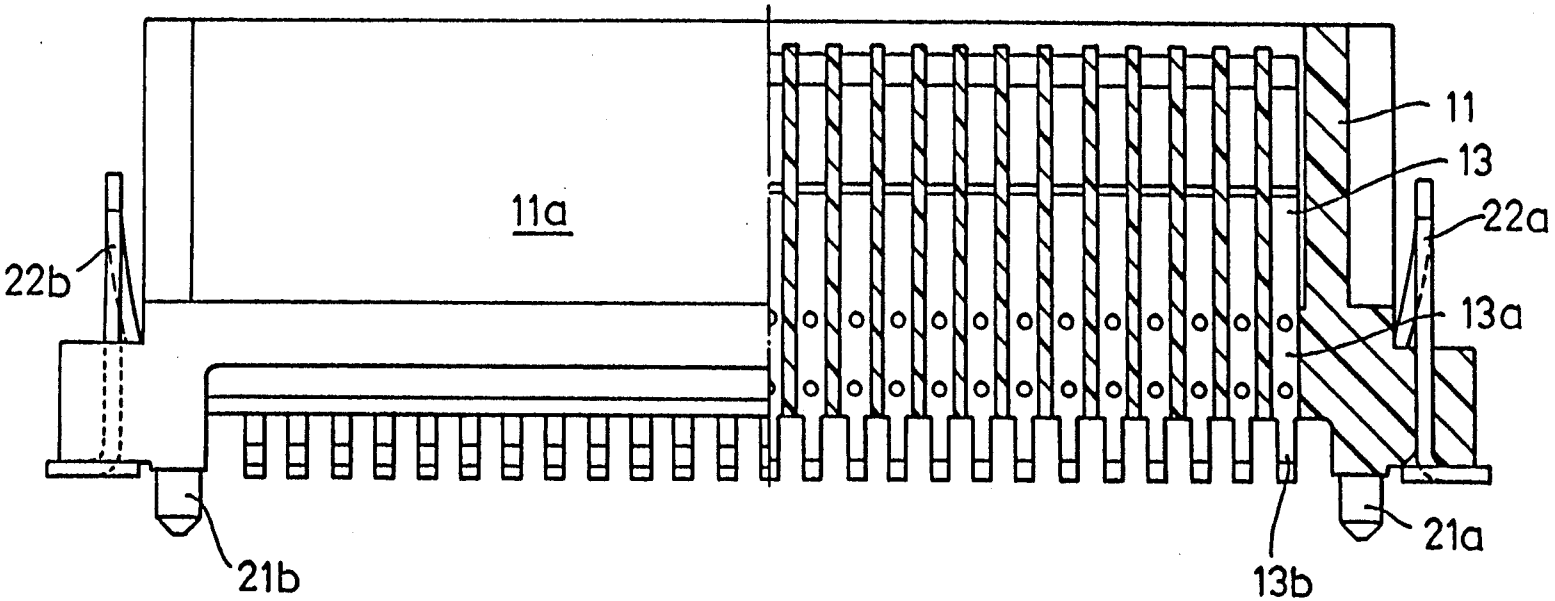
FIG. 2 is a side elevation of one of the housings of the connector shown in FIG. 1, with a part of the housing shown as removed.

Referring to FIGS. 1 to 3, a connector 10 according to the present invention comprises a pair of housings 11 and 12, which are formed with a synthetic resin material mutually into an identical configuration, preferably in a box shape. In their endwise view, the housings 11 and 12 respectively comprise one longitudinal half 11*a* or 12*a* and the other longitudinal half 11*b* or 12*b*, which two halves 11*a* and 11*b* or 12*a* and 12*b* are defining between them a groove 11*c* or 12*c*, the one half 11*a* or 12*a* is formed relatively smaller than the other half 11*b* or 12*b*, and the both housings 11 and 12 are formed to be mutually engageable, with the respective halves disposed to interdigitate so that the one half 11*a* of the one housing 11 will be disposed inside the other half 12*b* of the other housing 12 while the other half 11*b* of the one housing 11 will be disposed outside the one half 12*a* of the other housing 12.

In the respective housings 11 and 12, two arrays of contactors 13 and 14 are provided as disposed along the inner side wall of their one halves 11*a* and 12*a*, as seen in FIG. 1, while these contactors 13 and 14 are formed as punched out of flat and thin metal plate and formed substantially into a bar shape with such conducting metal material as a copper alloy and the like, as shown in FIG. 3. The respective contactors 13 and 14 are secured at their base portions 13*a* and 14*a* as urged into holding holes 15 and 16 made in bottom wall parts of the one halves 11*a* and 12*a* while extended ends 13*b* and 14*b* out of the bottom wall parts are bent outward into an L-shape. Along the inner side walls of the other halves 11*b* and 12*b* of the both housings 11 and 12. Further, along the inner side walls of the other halves 11*b* and 12*b* of the both housings 11 and 12, further two arrays of contactors 17 and 18 formed in the same manner as the foregoing contactors 13 and 14 are provided, so that the contactors 17 and 18 are also urged at their base portions 17*a* and 18*a* into holding holes 19 and 20 made in bottom wall parts of the other halves 11*b* and 12*b* of the both housings 11 and 12 while extended ends 17*b* and 18*b* out of the bottom wall parts are bent outward also into an L-shape.

The foregoing arrays of the contactors 13, 14 and 17, 18 are respectively made to be the same number of the conductors, so that a concurrent connection of multiple wires may be realized (since the arrangement of the respective arrays of the contactors 13, 14, 17 and 18 are substantially the same and, in FIG. 2, the housing 11 and the contactor array 13 disposed along the one half 11*a* of the housing 11 only are shown in FIG. 2). In this case, the extended ends 13*b*, 14*b* and 17*b*, 18*b* bent into the L-shape are disposed to extend mutually in opposite directions on the bottom wall parts of the housings 11 and 12, that is, adjacent to non-open side of the housings, so as to allow the connector to be easily mounted to, for example, a printed circuit substrate (not shown). Further, at both longitudinal end portions of the housings 11 and 12, there are provided upward and downward projections 21*a* and 21*b* for positioning the connector to the printed circuit substrate, as well as fixing metal terminals 22*a* and 22*b*, preferably, for mounting the connector to the printed circuit substrate (while FIG. 2 shows only the one housing 11, the other housing 12 is formed substantially in the same manner).

The contactors 13, 14, 17 and 18 shall now be detailed with reference to FIG. 3 but, since they are substantially all in identical formation, only one of the contactors 13 will be explained here as an example. That is, the contactor 13 is formed to have at a free end portion 13*c* a contacting part 13*d* bent into an L-shape at a relatively shallow angle and provided with a plating of such a noble metal as gold or the like which is excellent in the electric contact stability. Between the base portion 13*a* and the free end portion 13*c*, there is provided a slanted step 13*e* formed at an angle of about 30 degrees, preferably, so as to allow a reliable clicking action to be attained upon completion of the connection between the respective contactors of the both housing. It is preferable that these contacting part 13*d* and slanted step 13*e* are formed by means of a bending process with proper dies or the like since, according to such process, the required working can be easily executed even when a sufficient size minimization is attempted, with a higher precisioned work stably executed, in contrast to conventional expanding work. At the base portions 13*a* of the contactor 13, further, there are provided such projections 13*f* that will frictionally engage with inner face of the holding hole 15. All other contactors 14, 17 and 18 are formed in the same manner as the contactor 13 and their respective portions are denoted with the same suffixes as given to the contactor 13 in the drawings.

Figure 4:
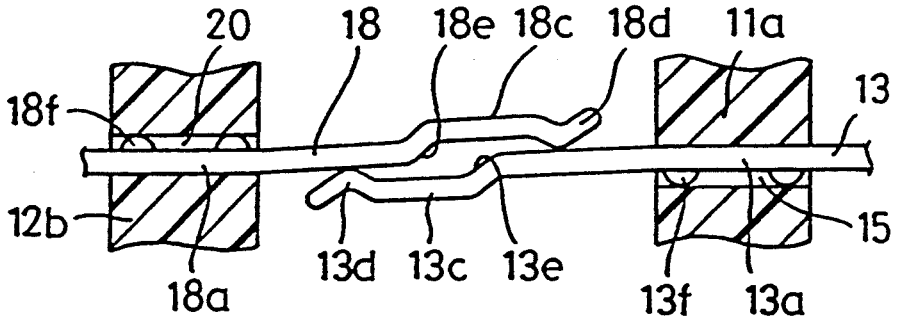
FIG. 4 is an explanatory view for contacting state between the contactors of the both housings forming the connector of FIG. 1.
Figure 5:
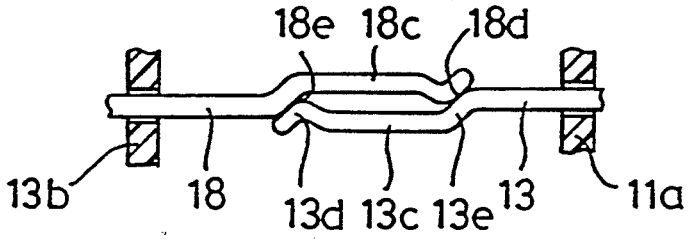
FIG. 5 is an explanatory view for a state in which the clicking action is attained in the connector of FIG. 1.

Now, as the housings 11 and 12 formed in a pair as has been described are engaged to each other, the respective arrays of the contactors 13 and 18 as well as 17 and 14 are also brought into resilient engagement with each other while mutually being caused to bendingly deform so as to come into a reliable contacting state at two points through their contacting parts 13*d* and 18*d* as well as 17*d* and 14*d*. That is, as shown in FIG. 4, the mutually opposing pair of the contactors 13 and 18 or 14 and 17 are made to engage at their contacting parts 13*d* and 18*d* or 14*d* and 17*d* with a portion closer to the base portions of the opposing contactors, while being resiliently bent by one another, so that, as represented by a solid line curve x of the relationship between the engaging strength and the engaging stroke of FIG. 6, in particular, by a portion between two points B and E of the curve, with the engaging strength between the opposing contactors varied relatively gradually so as to allow the both housings 11 and 12 to be engageable smoothly simply with finger tips or the like. During this engaging operation, the mutually sliding contacting parts 13*d* and 18*d* or 14*d* and 17*d* are caused to hit and pass the sloped steps 18*e* and 13*e* or 17*e* and 14*e* (see FIG. 5), upon which the mutual engaging strength is caused to become abruptly large to reach the maximum value and again abruptly smaller as is evident from a portion of the curve x adjacent a point E of FIG. 6, whereby a clicking action is provided to the finger tips so as to allow the completion of the contacting operation sensed by the operator.

Figure 6:
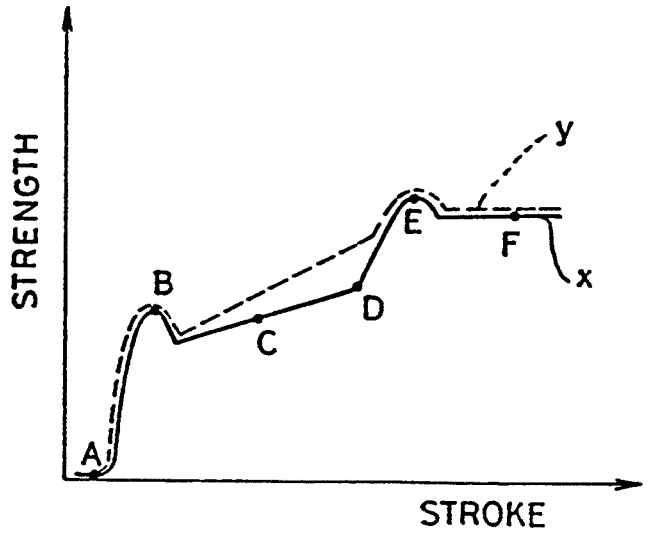
FIG. 6 is a diagram for showing the relationship between the engaging strength and the engaging stroke of the contactors in the connector of FIG. 1.
Figure 7A:
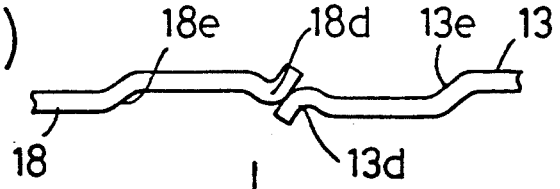
FIG. 7 are explanatory views for the sequence of the contacting operation between the contactors of the both housings of the connector shown in FIG. 1.
Figure 7B:
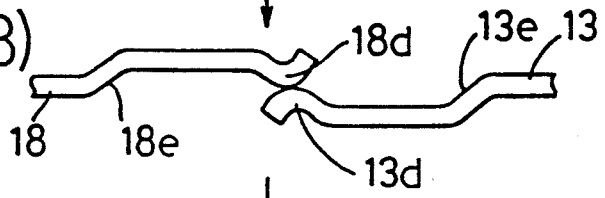
Figure 7C:
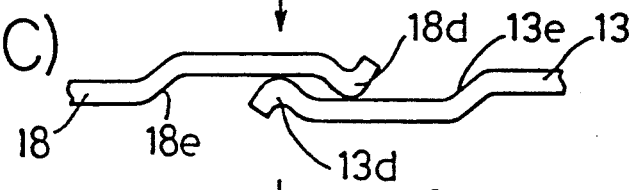
Figure 7D:
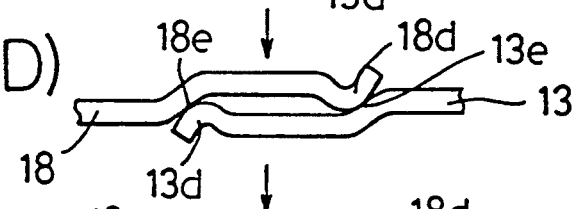
Figure 7E:
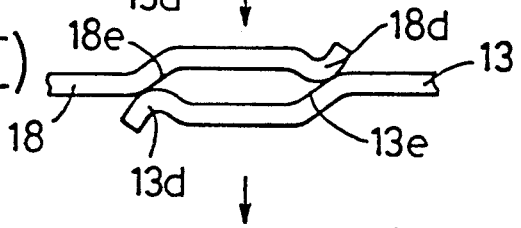
Figure 7F:
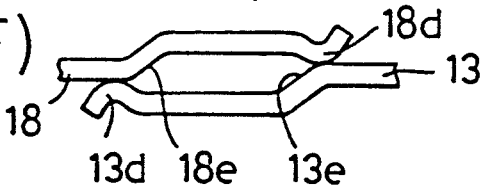
Figure 8:
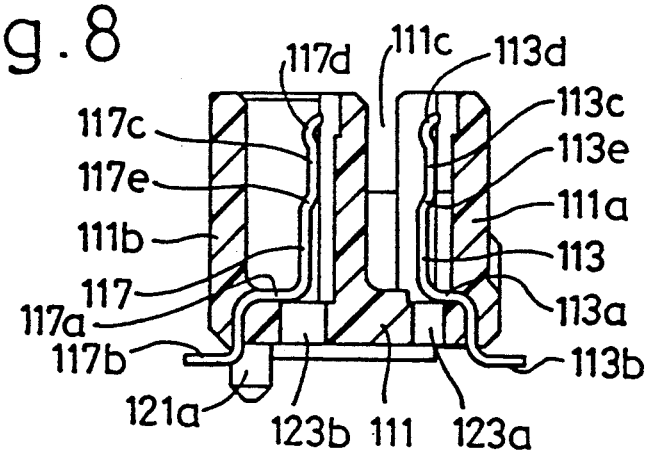
FIG. 8 shows in a cross section of one of the housings in another embodiment of the connector according to the present invention.
Figure 9:
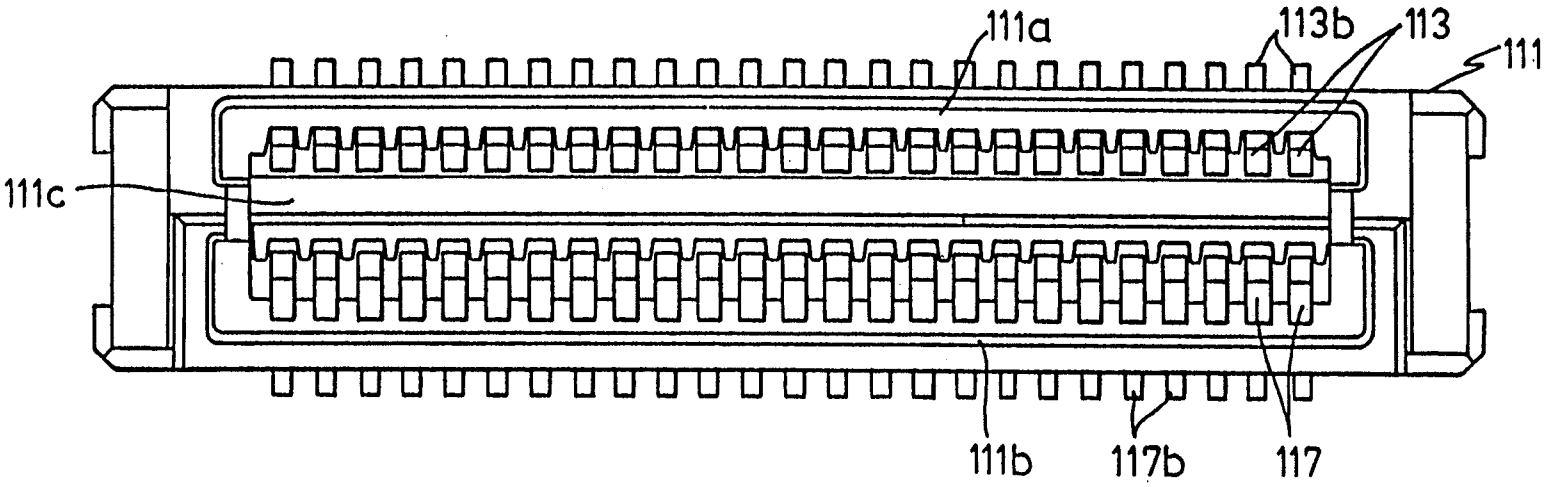
FIG. 9 is a plan view of the housing of the connector shown in FIG. 8.
Figure 10:
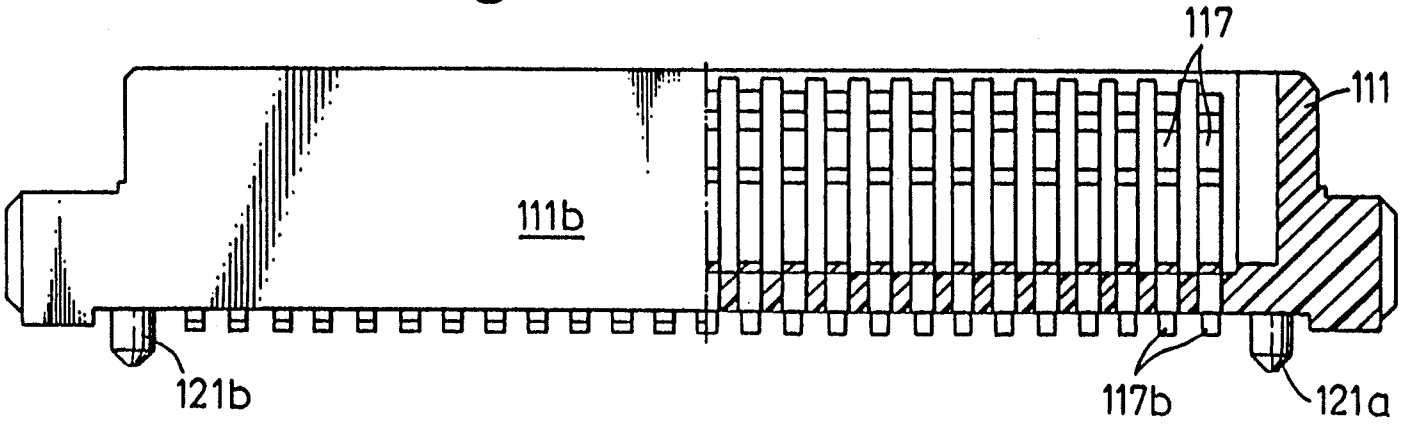
FIG. 10 is a side elevation of the housing of the connector shown in FIG. 8 with a part of the housing shown as removed.
Figure 11:
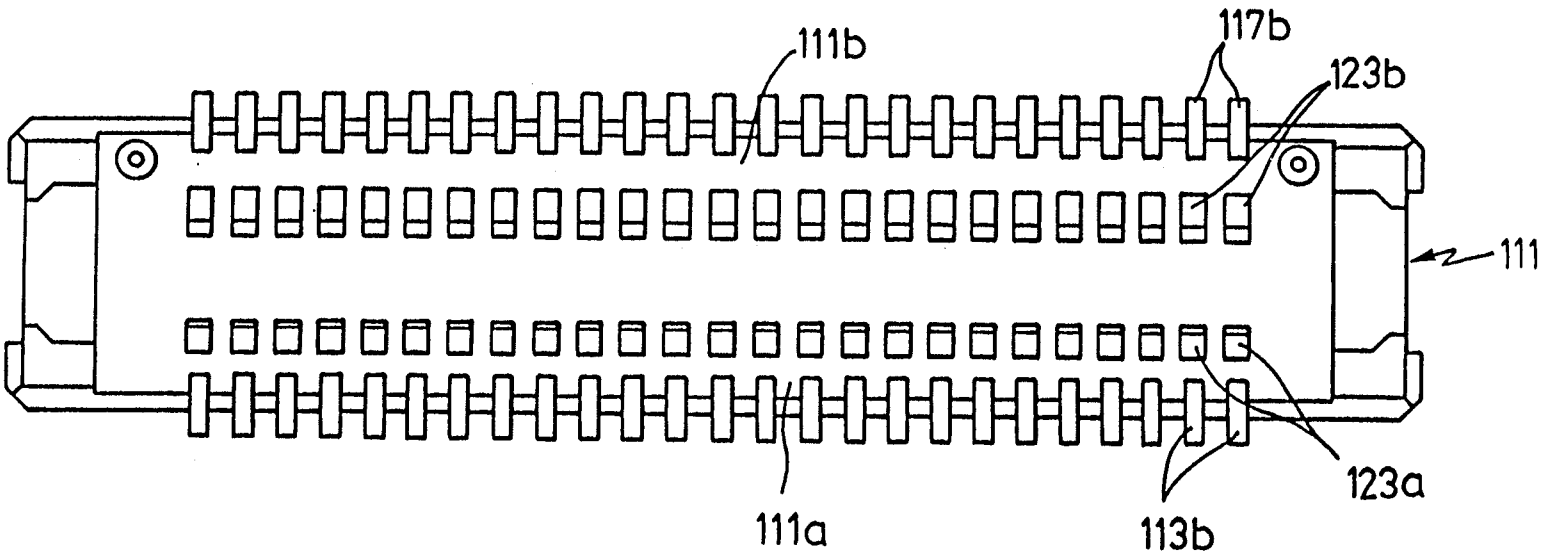
FIG. 11 is a bottom view of the housing of the connector shown in FIG. 8.

Referring more in detail to the contacting operation of the connector according the present invention with reference also to FIGS. 7(A) to 7(F), a gradual engagement of the pair of the housings 11 and 12 with each other causes the opposing contactors 13 and 18, for example, initially to hit each other at their contacting parts 13*d* and 18*d* as seen in FIG. 7(A), then to be slightly bent in mutually separating direction while keeping mutual engagement as seen in FIG. 7(B), and thereafter to once flex back after passing through the contacting parts 13*d* and 18*d* so as to mutually resiliently with each other at two points as seen in FIG. 7(C). Up to this moment, the engaging strength is caused to vary as represented by a portion between points A and C of the solid line curve x in FIG. 6, in which the engaging strength in initial period of the contacting operation is once increased abruptly as is evident from a portion adjacent the point B of the curve x to allow the operator to sense the initiation of the contacting operation. Further, as the engaging strength applied to the both housings 11 and 12 is increasingly continued, the tip end contacting parts 13*d* and 18*d* of the contactors 13 and 18 come to ride on the sloped steps 18*e* and 13*e* as shown in FIG. 7(D), and the contacting parts 13*d* and 18*d* slidingly passed through the sloped steps 18*e* and 13*e* as in FIG. 7(E) are brought into resilient contact with the contactors 18 and 13 at their portions closer to the base portions as in FIG. 7(F) so that the contactors 13 and 18 are brought into contact with each other mutually at two points with a high resilient contacting force, during which the engaging strength will vary as represented by a part following the point C and between points D and F of the solid line curve x in FIG. 6, as will be readily appreciated. Further, the variation in the engaging strength between the both housings of the connector of the present invention, as represented by the solid line curve x in FIG. 6, is more abrupt than that of a known connector as represented by a broken line curve y also shown in FIG. 6 so that, as will be also readily appreciated, an excellent clicking action can be attained.

In FIGS. 8 to 12, there is shown another embodiment of the connector according to the present invention, in which the respective arrays of the contactors are secured as integrally molded with the respective housings. In these drawings, the substantially identical constituent members with those in the foregoing embodiment of FIGS. 1–7 are denoted by the same reference numerals as used in FIGS. 1–7 but as added by 100. Referring more specifically to the present embodiment, the four arrays of the contactors 113, 114, 117 and 118 are formed as bent substantially into a Z-shape at their part from the base portions 113*a* to the externally extended ends 113*b*, 114*b*, 117*b* and 118*b*, and are integrally molded along the respective halves 111*a*, 111*b*, 112*a* and 112*b* of the both housings 111 and 112 as embedded therein at an intermediate portions of the Z-shape bent parts. Further, the contactors 113, 114, 117 and 118 are so arranged that their parts including the free end portions 113*c*, 114*c*, 117*c* and 118*c* having the shallow L-shaped contacting parts 113*d*, 114*d*, 117*d* and 118*d* as well as the sloped steps 113*e*, 114*e*, 117*e* and 118*e* are extended along the inner side faces of the housing halves 111*a*, 111*b*, 112*a* and 112*b* while the other extended ends 113*b* and 117*b* out of the housing 111 as well as the extended ends 114*b* and 118*b* out of the housing 112 are disposed to extend mutually in opposite directions, for ready mounting of the connector to the printed circuit substrate (not shown).

In the bottom wall parts of the housings 111 and 112, further, there are provided through holes 123*a*, 123*b*, 124*a* and 124*b* at positions adjacent to securing positions of the contactors 113, 114, 117 and 118, so that these through holes will function as discharge ports for a cleaning liquid.

Figure 12:
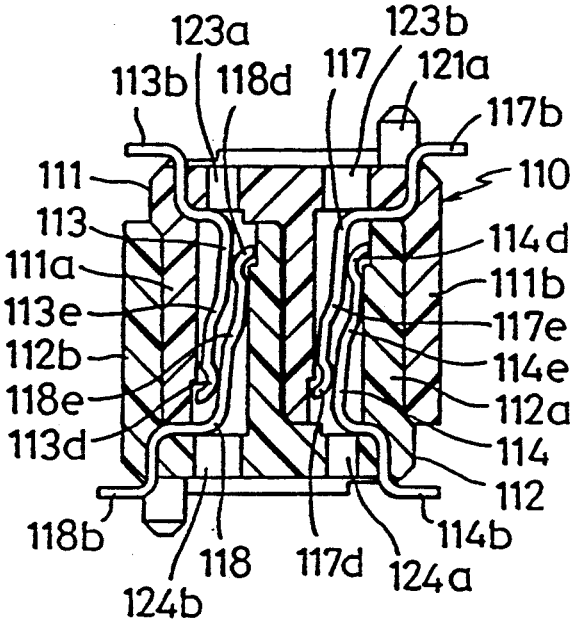
FIG. 12 shows in a cross section of the connector shown in FIG. 8 with the both housings in engaging state.

In the present embodiment, too, the mutual engagement of the both housings 111 and 112 causes the mutually opposing arrays of the contactors 113 and 118 as well as 117 and 114 to resiliently bend each other and eventually to be brought into the reliable contacting state as optimumly resiliently contacted at the two points with each other, throught the substantially the same sequences of the variation in the engaging strength as shown in FIG. 6 and providing the excellent clicking action upon the completion of the connecting operation (as seen particularly in FIG. 12). In addition, according to the present embodiment, the Z-shaped bending of the respective contactors will be effective to soften any shock applied when the opposing contactors are mutually engaged upon the engagement of the housings 111 and 112. Further, with the integral molding of the contactors 113, 114, 117 and 118 with the housings 111 and 112, it is made possible to render the length of a range for which the contactors directly contact with the housings to be larger, so as to be able to firmly secure the respective contactors to the housings. On the other hand, the contactors are to be partly embedded in the housings as integrally molded therewith, so that a reinforcement can be provided to the housings. Further, since the contactors are to be firmly secured to the housings while an effective reinforcement of the housings can be realized at their portions where the contactors are molded integrally with the housings, it is made possible to render the thickness of the bottom wall parts of the housings 111 and 112 to be smaller though the through holes 123*a*, 123*b* and 124*a*, 124*b* are made in the portions, and thus to effectively reduce the entire height of the connector.

Figure 14:
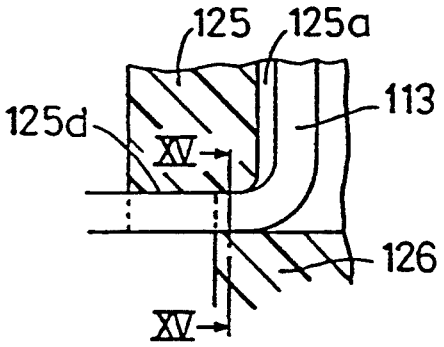
FIGS. 13 and 14 are fragmentary sectioned views of dies employed for manufacturing the connector of FIG. 8.
Figure 13:
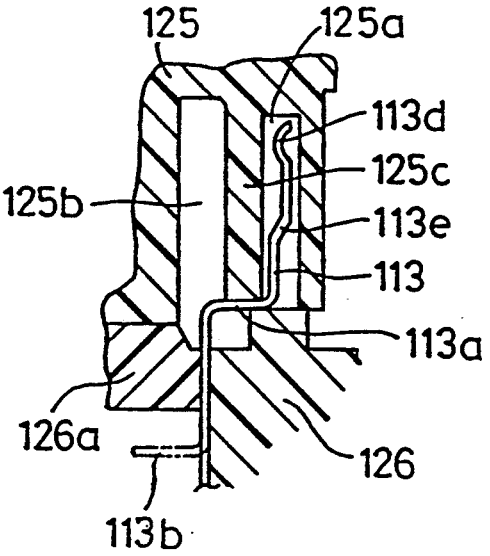
Figure 15:
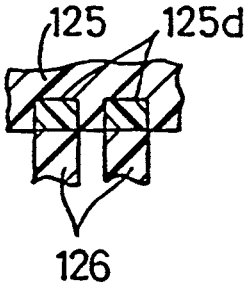
FIG. 15 is a fragmentary sectioned view of the dies of FIG. 14 taken along line XV-XV.

Next, the steps for integrally molding the contactors 113, 114, 117 and 118 with the housings 111 and 112 shall be described with reference to one of the contactors 113 as an example. That is, as shown in FIG. 13, an upper molding die 125 is provided with a recess 125*a* for accommodating therein the free end part 113*c* of the contactor 113, a partition 125*c* is provided to the die 125 between the recess 125*b* for integrally forming the half 111*a* of the housing 111 and, along bottom end face of this partition 125*c*, a so-called parting line, there is provided a groove 125*d* substantially of an identical width with that of the contactor 113 at its intermediate portion bent into the Z-shape (see FIGS. 15 and 16). The contactor 113 is thus inserted at the intermediate portion into the groove 125*d*, and a lower die 126 is fitted to the upper die 125 with a corner of the lower die 126 engaged to a part of the intermediate portion in the base portion 113*a* of the contactor 113 inserted in the groove 125*d* of the upper die 125 to thereby close the recess 125*a*, as shown in FIG. 14. Then, the base portion 113*a* of the contactor 113 inserted in the recess 125*b* of the upper die 125 and exposed out of the lower die 126 is bent at a proper position, and a synthetic resin is poured into the recess 125*b* and into a cavity defined between a slide core 126*a* and the lower die 126, whereby the housing 113 and the intermediate portion at the base portion 113*a* of the contactor 113 can be integrally molded. In this event, the other recess 125*a* of the upper die 125 is closed by the lower die 126 and base portion 113*a* of the contactor 113 so that no synthetic resin will enter therein. Thereafter, the extended end 113*b* of the contactor 113 is subjected to a bending work at a position closer to the bottom wall face of the housing 111. Provided at this time that a distance between the bottom wall face of the housing 111 and the bent position at the extended portion 113*b* of the contactor 113 is kept small, it is made possible to execute reliably a soldering work of the extended end 113*b* with respect to the printed circuit substrate 127 as shown in FIG. 17 even when the solder 127*a* is apt to flow upward along the extended end 113*b* of the contactor 113, without causing a so-called wicking phenomenon as restricted by the bottom wall face of the housing 111. Further, the extended ends 113*b* and 117*b* as well as 114*b* and 118*b* of the respective arrays of the connectors 113 and 114 as well as 114 and 118 respectively disposed to oppose each other are extended mutually in opposite directions so that a space between these extended ends can be well utilized as a vacant space and, in mounting the connector to the printed circuit substrate 127, a highly dense wiring can be provided onto the substrate 127 immediately below the connector.

In the above described embodiment with reference to FIGS. 8 to 17, other constituent elements and their function are the same as those in the foregoing embodiment of FIGS. 1 to 7.

Figure 19:
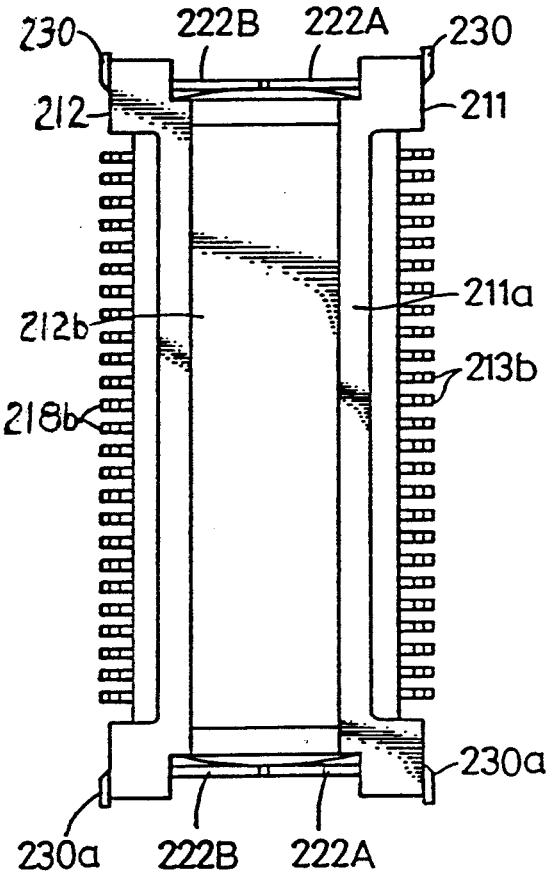
FIG. 19 is a side elevation of the connector of FIG. 18 in the engaging state of the both housings.
Figure 20:
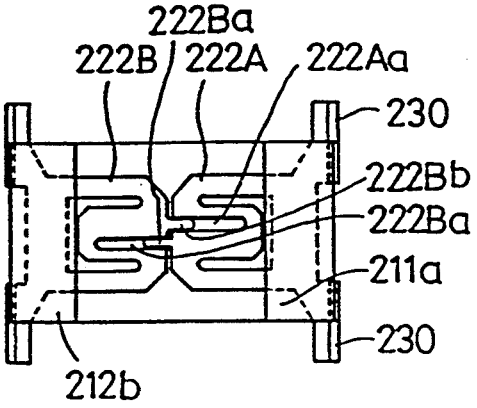
FIG. 20 is a front view of the connector of FIG. 18 in the engaging state.

In FIGS. 18 to 20, there is shown still another embodiment of the connector according to the present invention, in which the both housings 211 and 212 are provided at their both longitudinal end faces with each of a pair of engaging metal fittings 222A and 222B, as secured thereto by means of, for example, an integral molding. Each of the metal fittings 222A and 222B comprises a notch 222Aa or 222Ba and a projection 222Ab or 222Bb, so that the projection 222Bb of the metal fitting 222B will engage in the notch 222Aa of the metal fitting 222A while the projection 222Ab of the metal fitting 222A will engage in the notch 222Ba of the metal fitting 222B, whereby, when the both housings 211 and 212 are mutually disconnected, they can be effectively guided in their separating direction by means of the projections and notches even when any twisting force of the like external force is applied, so as to prevent any twisting or the like stress from being given to the housings 211 and 212. Consequently, soldered parts between the connector and the printed circuit substrate can be prevented from being impaired or damaged by the twisting or the like stress.

Further, it is preferable that the foregoing engaging metal fittings 222A and 222B are made to function also as grounding terminals. Further, it is also preferable that fixing metal terminals 230 and 230*a* for mounting the connector to the printed circuit substrate are provided to the both longitudinal ends of the housings as divided to both side edges at each end, so as to allow part 228 of printed circuit pattern on the printed circuit substrate 227 can be disposed between the both-side divided metal terminals 230 or 230*a*, as shown in FIG. 18, and the effective surface area of providing the circuit pattern can be increased.

In the embodiment of FIGS. 18 to 20, all other constituent elements and their functions are the same as those in the foregoing embodiments and, in these drawings, the same elements as those in the embodiments of FIGS. 1 to 7 are denoted by the same reference numerals as the ones used in FIGS. 1 to 7 but as added by 200.

Figure 21:
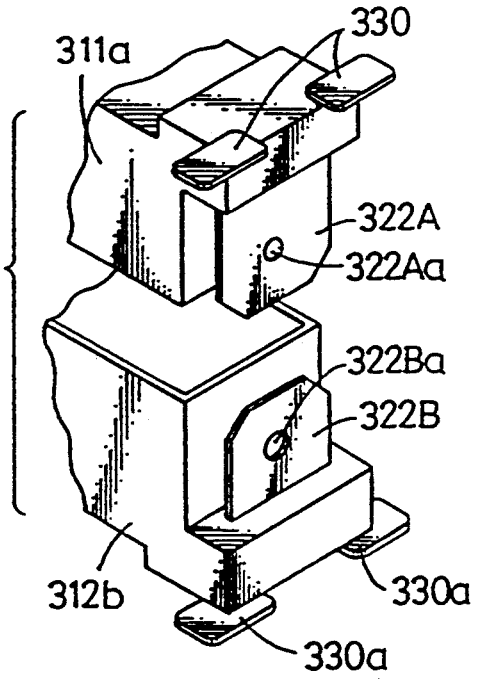
FIG. 21 shows in a fragmentary perspective view in still another embodiment of the connector according to the present invention, with the both housings shown as disengaged from each other.
Figure 22:
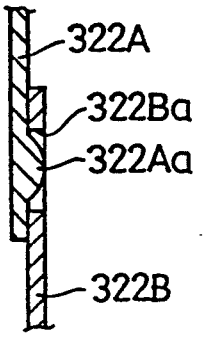
FIG. 22 is a fragmentary sectioned view in locking state of locking metal fittings employed in the connector of FIG. 21.

In FIGS. 21 and 22, there is shown still another embodiment of the connector according to the present invention, in which engaging metal fittings 322A and 322B are secured to the respective longitudinal ends of the both housings 3111 and 312, while one 322A of the metal fittings is provided with a projection 322Aa and the other metal fitting 322B is made to have a receiving hole 322Ba, so that the projection 322Aa will engage in the receiving hole 322Ba upon engagement of the housings 311 and 312 with each other. Accordingly, the both housings 311 and 312 engaged with each other are made into locked state with such engaging metal fittings 322A and 322B, and the connecting parts or the like of the connector with the printed circuit substrate can be prevented from being affected by any externally given stress applied to the housings 311 and 312 and concentrated in particular to the extended terminals of the contactors. All other constituent elements and their functions in this embodiment are the same as those in the respective foregoing embodiments, and the same both-side divided provisions of fixing metal fittings 330 and 330*a* as in the embodiment of FIGS. 18 to 20 can be also adopted in the present instance.

What is claimed is:

1. A method for manufacturing a connector which comprises a pair of housings engageable with each other and contactors secured at their base portion by a bottom wall part of each of said housings for resilient contact at contacting point of free end portion with corresponding ones of said contactors of the other housing, the method comprising the steps of preparing a pair of upper and lower dies mutually defining between them first and second recesses and a parting line having grooves substantially of an identical width with said contactors, first recess being provided for accommodating therein said base portion and free end portion of each of the contactors including a sloped step made between the base and free end portions for providing a clicking action, inserting the base portions of the respective contactors in the grooves of said dies and the free end portions of the contactors in said first recess of the dies, engaging the upper and lower dies with each other to close said first recess with the base portions of the contactors in said grooves and the dies in engagement, and pouring a synthetic resin into said second recess to integrally mold the housing with the base portions of the contactors.

2. The method of claim 1, wherein said contactors are each respectively of a bar-shaped member formed as punched out of a thin metal plate and made to have said base portion, sloped step and free end portion which has said contacting between the base and free end portions by means of a bending point, and the steps further comprise, subsequent to said step of pouring the synthetic resin, a step of bending an extended end part of the base portion of the contactors at a position close to said bottom wall part of said housing.

* * * * *